US005868316A

United States Patent [19]

Scott

[11] Patent Number: 5,868,316

[45] Date of Patent: Feb. 9, 1999

[54] MULTI-COLOR NOZZLE RACK AND METHOD FOR MAKING SAME

[75] Inventor: Loren W. Scott, Carlsbad, Calif.

[73] Assignee: Hunter Industries Incorporated, San Marcos, Calif.

[21] Appl. No.: 628,023

[22] Filed: Apr. 4, 1996

[51] Int. Cl.[6] ..... B05B 3/14

[52] U.S. Cl. ..... 239/73; 239/74; 239/206

[58] Field of Search ..... 239/71, 73, 74, 239/391, 206; 425/130; 264/297.2

[56] References Cited

U.S. PATENT DOCUMENTS

| | | | |
|---|---|---|---|
| 2,451,448 | 10/1948 | Sawyer | 264/297.2 |
| 3,013,308 | 12/1961 | Armour | 264/297.2 |
| 3,774,756 | 11/1973 | Carlile et al. | 264/297.2 |
| 3,799,453 | 3/1974 | Hart | 239/391 |
| 4,277,434 | 7/1981 | Conway | 264/297.2 |
| 4,570,858 | 2/1986 | Bitner et al. | 239/390 |
| 5,069,615 | 12/1991 | Schad et al. | 425/556 |
| 5,202,074 | 4/1993 | Schrenk et al. | 264/241 |
| 5,451,000 | 9/1995 | Shaw et al. | 239/71 |
| 5,456,411 | 10/1995 | Scott et al. | 239/73 |
| 5,670,184 | 9/1997 | Nakamichi et al. | 425/130 |

*Primary Examiner*—Andres Kashnikow
*Assistant Examiner*—Lisa Ann Douglas
*Attorney, Agent, or Firm*—Michael H. Jester

[57] ABSTRACT

A system of multi-colored sprinkler nozzles are molded simultaneously in a multi-cavity mold and emerge from the mold in an interconnected rack of multiple nozzles having nozzles of multiple units with common characteristics identified by common color.

21 Claims, 5 Drawing Sheets

MULTI-COLOR NOZZLE RACK AND METHOD FOR MAKING SAME

BACKGROUND OF THE INVENTION

The present invention relates to irrigation sprinklers and pertains particularly to an improved multi-nozzle rack and method of making same.

The artificial distribution of water through irrigation systems is in wide use throughout the world today. There are many irrigation systems utilized, with each having its own benefits and drawbacks.

One of the most widely used systems, particularly where water is not abundant or plentiful, is a sprinkler system wherein a plurality of sprinkler units are positioned about a land area for distributing water over the surface of the land area. Such systems are widely used for lawns, golf courses, playing fields and many field crops.

Most sprinkler units currently used have replaceable nozzles wherein different nozzles may be selected and mounted in the sprinkler unit to achieve desired range and rate of coverage. A given irrigation system may have many different sprinkler units of the same type, with each having many different nozzles for different reaches and/or arcs of coverage. It may also be desirable or necessary to change nozzles often for a given area to obtain an optimum precipitation rate or area of coverage.

It is also desirable that an installer be able to stock one model of sprinkler unit and select the nozzle having the desired parameters for coverage and the like after the sprinkler unit is installed. In a prior U.S. Pat. No. 5,456,411 of assignee hereof a quick mount nozzle system is disclosed wherein nozzles are colored to identify at least one major parameter so that they may be quickly and easily selected and installed in a sprinkler unit. In accordance with that prior invention, nozzles having a common parameter such as flow rate, for example, are usually molded of the same color and molded in racks of multiple nozzles. Thus, several different colored racks may be packaged with a sprinkler unit. It would be desirable to have a single rack having multiple nozzles of different colors identifying common characteristics to package with a sprinkler unit. It would be desirable to provide all possible nozzles on a common rack with a sprinkler unit. It would be desirable to be able to mold all nozzle variations in a single mold. It would also be desirable to have sets of nozzles of different colors on a common rack.

Accordingly, it is desirable that a sprinkler system be available having a plurality of sprinkler nozzles that are on a common rack and color coded different colors for providing desired coverage over a wide range of arcs and spacings.

SUMMARY AND OBJECTS OF THE INVENTION

Accordingly, it is a primary object of the present invention to provide sprinkler replaceable nozzles on a common rack.

In accordance with the primary aspect of the present invention, a rack of sprinkler units is molded with sprinkler nozzles of different colors to designate the parameters of the nozzles.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Nozzle sets may be provided on racks, that is, molded connected together for easy tear off and in colors, with the colors showing one of the parameters such as the arc. For example, a nozzle set having an arc range of from forty degrees to one-hundred thirty-five degrees may be provided in the color code brown. A half arc nozzle set may be provided in ranges of from one-hundred thirty-five degrees to two-hundred twenty-five degrees in a color code of green. A three-quarter nozzle set will be provided in an arc range from two-hundred twenty-five degrees to three-hundred fifteen degrees in a color code, for example, of blue.

A full circle nozzle set with arc ranges of from three-hundred fifteen degrees to three-hundred sixty degrees may be provided in a color code of black, for example. Each of these sets will have a nozzle for a spacing such as, thirteen to fifteen feet, a nozzle for spacing of sixteen feet to nineteen feet, a nozzle for spacing of twenty feet to twenty-four feet, a nozzle for spacing of twenty-five feet to twenty-nine feet, and a nozzle for spacing of thirty feet to thirty-four feet. Thus, a large range of matched nozzles providing a matched precipitation system is provided.

This nozzle system enables the easy selection and replacing of nozzles to achieve uniform precipitation and provides means for providing a spray uniformity over its spacing ranges. The two important parameters necessary for the installer in choosing nozzles are the arc and the spacing range required for each sprinkler. The quick snap nozzle system allows the installer to select from at least four nozzle sets of quarter, half, three-quarter and full, with at least the spacing ranges as specified above selectable for each arc. Other ranges can be easily provided with this system.

These sprinkler units with quick engagement nozzles as pointed out above, permit the easy and economical installation of sprinkler systems for various plots of ground with minimal valving and controlling units and piping. For example, various shaped lawn areas can be laid out with a sprinkler system of the present invention with minimal complexity and with substantially uniform coverage.

Figure 1:
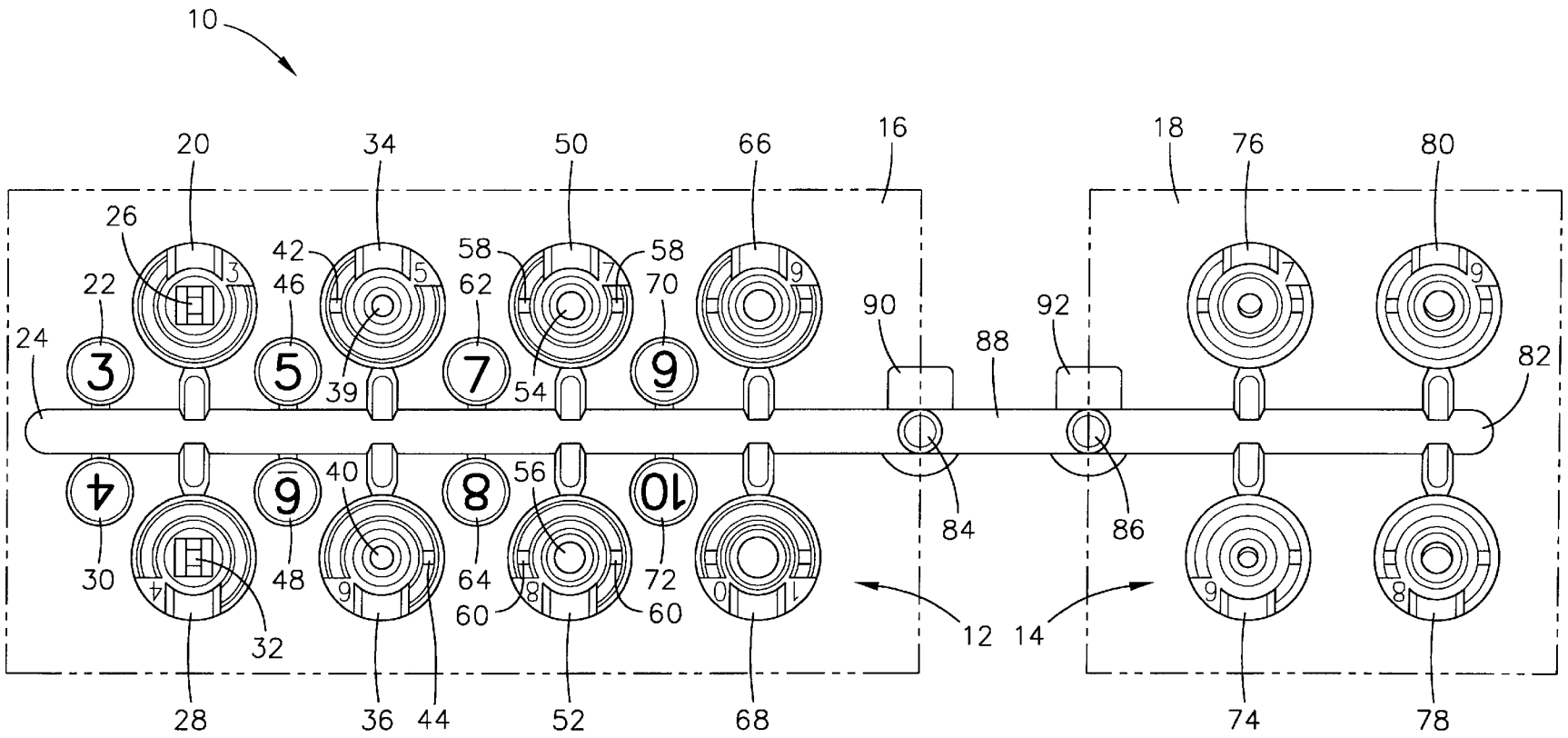
FIG. 1 is a front elevation view of a rack of sprinkler units in accordance with a preferred embodiment of the invention.

Referring to FIG. 1 of the drawings, an exemplary embodiment of an assembly of nozzles in accordance with the invention is illustrated and designated generally by the numeral 10. In accordance with the present invention, a plurality of nozzles adapted for a particular sprinkler unit and having some common characteristics and diverse characteristics are packaged together on a unitary structure that is molded together on a unitary structure and embodies a different color for different nozzles having specified characteristics. As discussed in the background of the invention, many different nozzles may be provided for a particular sprinkler unit enabling a user to replace the nozzle to achieve a desired rate or range of coverage.

The rack of nozzles illustrated in FIG. 1 represents two different sets of nozzles, each set designated generally as 12 and 14, respectively. In the illustrated example, the set 12 represent standard nozzles and are all of the same color representing a code defining a common characteristic. The nozzles in the illustrated embodiment are of a red color representing a standard nozzle. The nozzles are also coded with a number which may appear either on the nozzle itself or on the rack. The two sets of nozzles 12 and 14 are simultaneously molded in accordance with the invention, in separate sections 16 and 18 of a common multi-cavity mold. The illustrated embodiment shows an exemplary rack of nozzles with the set of nozzles 12 being standard nozzles, for example, of one color and the set of nozzles 14 being low-angled nozzles of another color. In this example, all of the nozzles in the set 12 are red in color and all nozzles in the set 14 are gray in color.

Referring more specifically to the set of nozzles 12, as can be seen, the set of nozzles 12 includes 8 nozzles all having at least one common characteristic designated by the color red and each being different in other characteristics, such as the flow rate. A nozzle 20 is designated with a code number 3 on a tab 22 on a branch 24 of the rack or runner system. These tabs enable the quick identification of the proper parameter for the particular nozzle 20 and easy selection of the nozzle with the proper parameters.

Similarly, a nozzle 28 is disposed opposite nozzle 20 and has an orifice of the same configuration and designated by the numeral 4 on a tab 30. The remaining nozzles in the set 12 have similar codes designating the particular parameter designated by the numeral. As will also be appreciated from the illustration, the orifices of the remaining six nozzles of the set have orifices that are circular in configuration, but of a different size.

A pair of nozzles, 34 and 36, have similar circular orifices 38 and 40, respectively, of a different size. These nozzles are also coded by the numerals 5 and 6 on nozzles 34 and 36. These nozzles each also have a single side orifice 42 and 44 with the nozzles designated by the numerals 5 and 6 on tabs 46 and 48, respectively. A pair of nozzles 50 and 52 are molded to offset each other with circular orifices 54 and 56 of different diameters. Each of these nozzles has a pair of side orifices 58 and 60, respectively. These nozzles are also separately identified by separate numbers 7 and 8 on tabs 62 and 64.

Another pair of nozzles, 66 and 68, each having circular orifices of different size and designated by numerals 9 and 10 on tabs 70 and 72 complete this set of nozzles on the rack.

The set of nozzles 14 are met up by a pair of nozzles 74 and 76 each having on the nozzle itself the numbers 6 and 7, respectively. Another pair of nozzles, 78 and 80, completes this set of nozzles.

As pointed out above the sets of nozzles are of a different color designating a different parameter. The nozzles are molded in a common multi-cavity mold fed by one or more injector or extruder assemblies, as will be disclosed. In the illustrated embodiment the rack is made up of the nozzles molded on the common runner with branches 24 and 82 extending in opposite directions from a central area where the molded plastic is injected through a pair of separate channels at 84 and 86 with a connecting channel 88 there between. Thus, plastic of one color for the molding of the nozzle set 12 may be injected at 84, while a plastic of a second color for molding the set 14 is injected at point 86. A connecting channel 88 is provided between them for providing a connector so that both sets of nozzles exit from the mold on a common carrier or support member, thereby forming what is called in the trade either a "tree" or "rack". Thus, multiple sets of nozzles of multiple different colors may be packaged together on a single structure for insertion with each sprinkler unit package.

Figure 2:
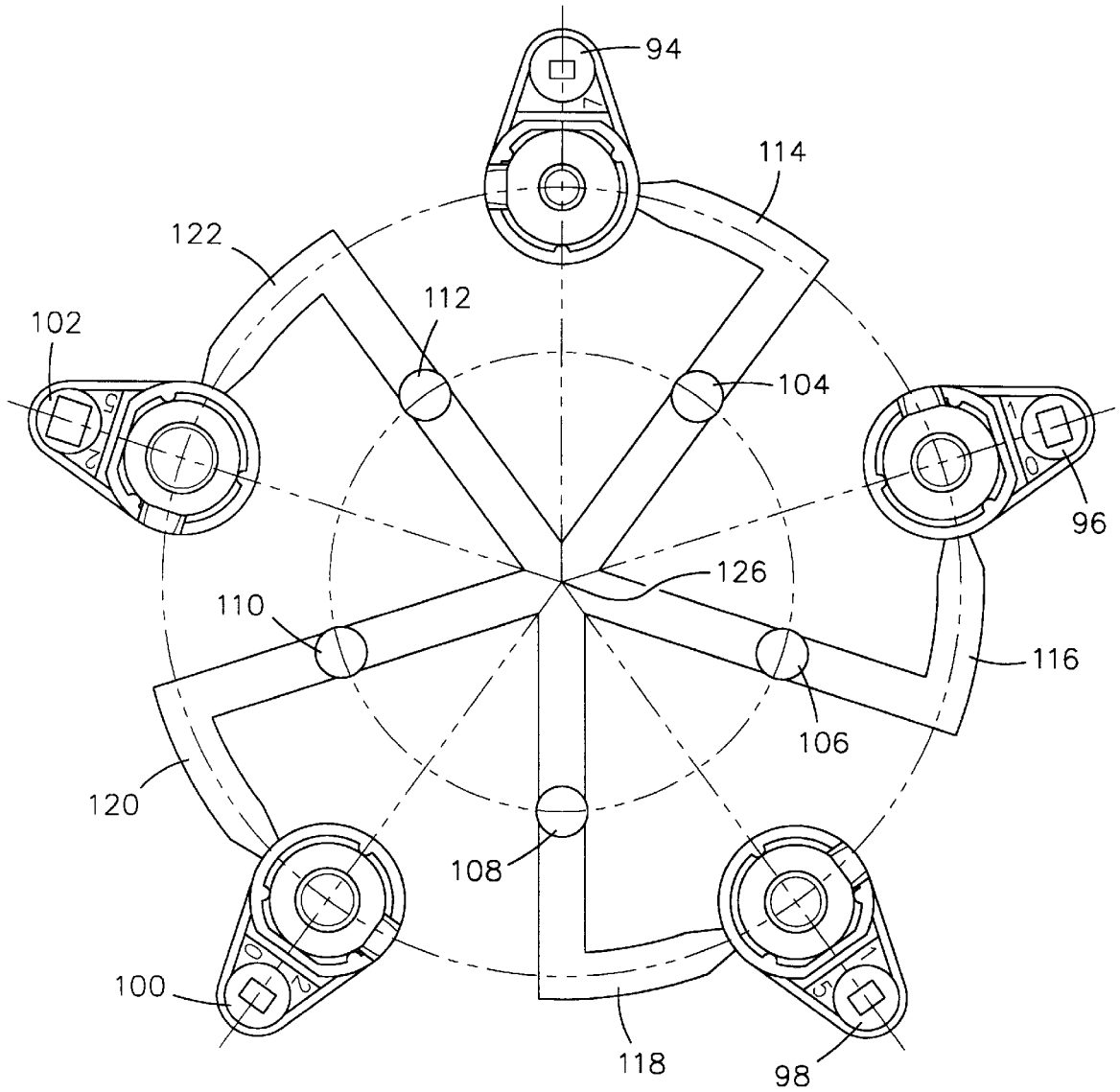
FIG. 2 is a view like FIG. 1 of an alternate rack of sprinkler units.

Referring to FIG. 2, an alternate exemplary embodiment of multiple nozzles which may make up a single set on a common support or carrier structure is shown. In this embodiment, each nozzle is of a different color and all nozzles are molded in a common multiple cavity mold. In this embodiment, the mold is made up and laid out for an arrangement for molding nozzles 94, 96, 98, 100 and 102 in a circular array in a common multi-cavity mold. The mold is set up for molding each nozzle of a different color with separate inlets at 104, 106, 108, 110 and 112 into the mold runner arrangement. The runner arrangement has runners 114, 116, 118, 120 and 122 going outward from the inlets to the respective nozzle mold cavity. With each of these, plastic of a different color will enter the mold at the different ports. The plastic will flow outward along the runner systems to the respective nozzle cavity. Simultaneously, molten plastic will flow inward along the runners 114, 116, 118, 120 and 122 to a common central position joining at 126. Thus, the nozzles will each be molded of a different color and will emerge from the mold cavity on a common support structure. This forms a set of nozzles each having a different color.

Figure 3:
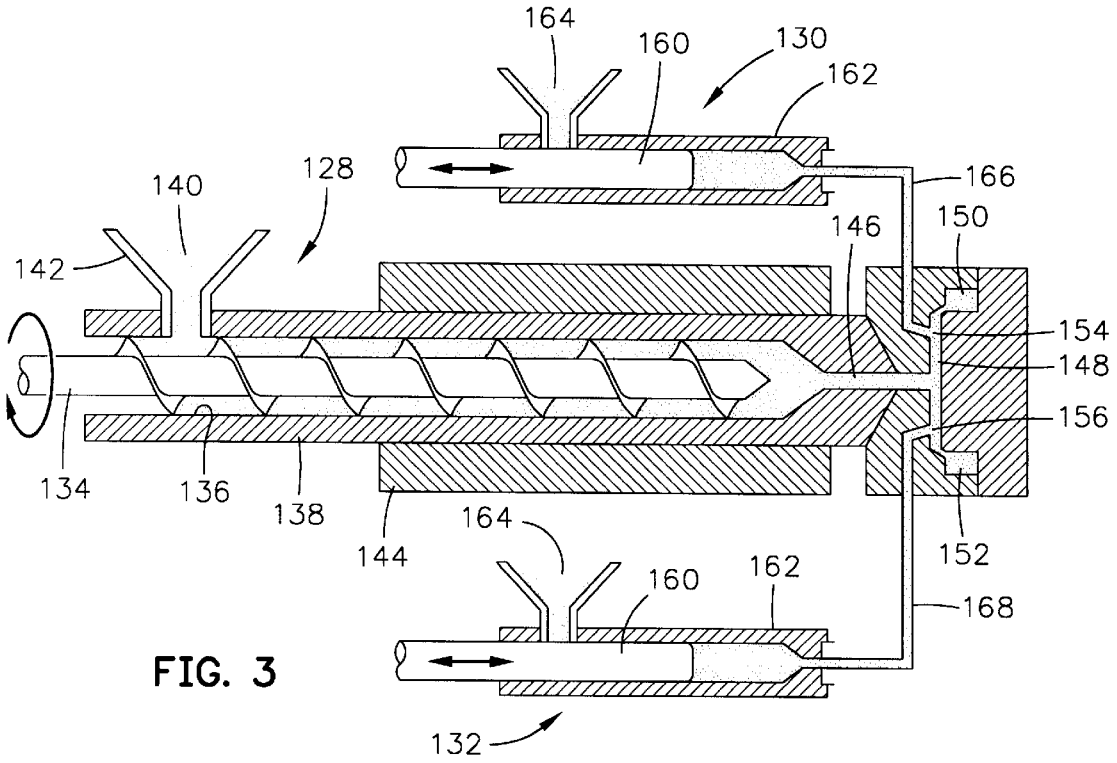
FIG. 3 is a diagrammatic view of an injecting molding system for producing nozzles in accordance with the invention.

The cavities of either of these molds may be filled by a single extruder having multiple dye injection ports upstream of each cavity or they may be filled with separate extruders. For example, as illustrated in FIG. 3, an exemplary plastic injection system may be as illustrated, comprising a screw extruder designated generally as 128 for the plastic extrusion and one or more separate dye injectors designated 130 and 132, respectively. As illustrated, a screw 134 is rotatably mounted in a bore 136 of a barrel 138 and receives plastic granules or pellets 140 from a hopper 142. The rotating screw 134 drives the plastic granules or pellets forward in the barrel where a heater 144 heats the barrel to melt the plastic in combination with the pressure and forces the molten plastic through an orifice 146 into a network of runners 148 into the mold structure.

The mold is formed with a number of runners which run outward to mold cavities 150 and 152. Suitable dye injectors inject dye into the molten plastic somewhere in the runner network in the mold prior to the cavities. In the illustrated embodiment dye is injected at ports 154 and 156 from injectors 130 and 132. The injectors may take any suitable form, but as illustrated comprise rams 160 inside a barrel 162 and receiving dye from a reservoir 164 and injecting it by way of suitable supply lines 166 and 168 to the respective ports 154 and 156. In this illustrated embodiment a single injector injects the molten plastic into multiple molds having multiple mold cavities with the dye being injected into the runner system intermediate the injection port and the cavity of the mold. Thus, any number of dye injectors may be utilized for injecting different colors of dyes into each respective mold or into groups of molds in a multi-cavity mold.

Figure 4:
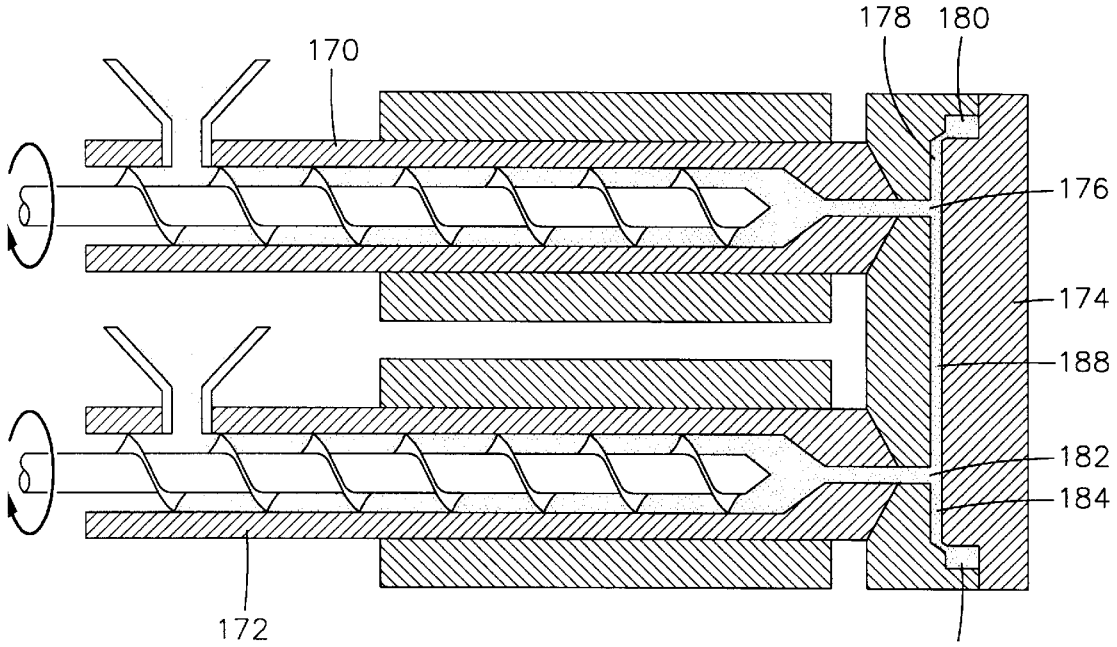
FIG. 4 is a diagrammatic view of an alternate injecting molding system for producing nozzles in accordance with the invention.

Referring to FIG. 4 there is illustrated an alternate arrangement wherein a pair of extruders 170 and 172 are supplied with plastic granules or pellets which may also include dye which is then extruded into a runner system in a multi-cavity mold 174. The runner system as illustrated has an inlet port at 176 for plastic from extruder 170 where the molded plastic enters an outer runner 178 to one or more mold cavities 180. Similarly, the injector 172 injects molten dye via a port 182 into an outer runner system 184 to one or more cavities 186. An inner runner system 188 joins at the center of the cavity to form a support structure to support the multiple nozzles coming from the multi-cavity mold.

Figure 5:
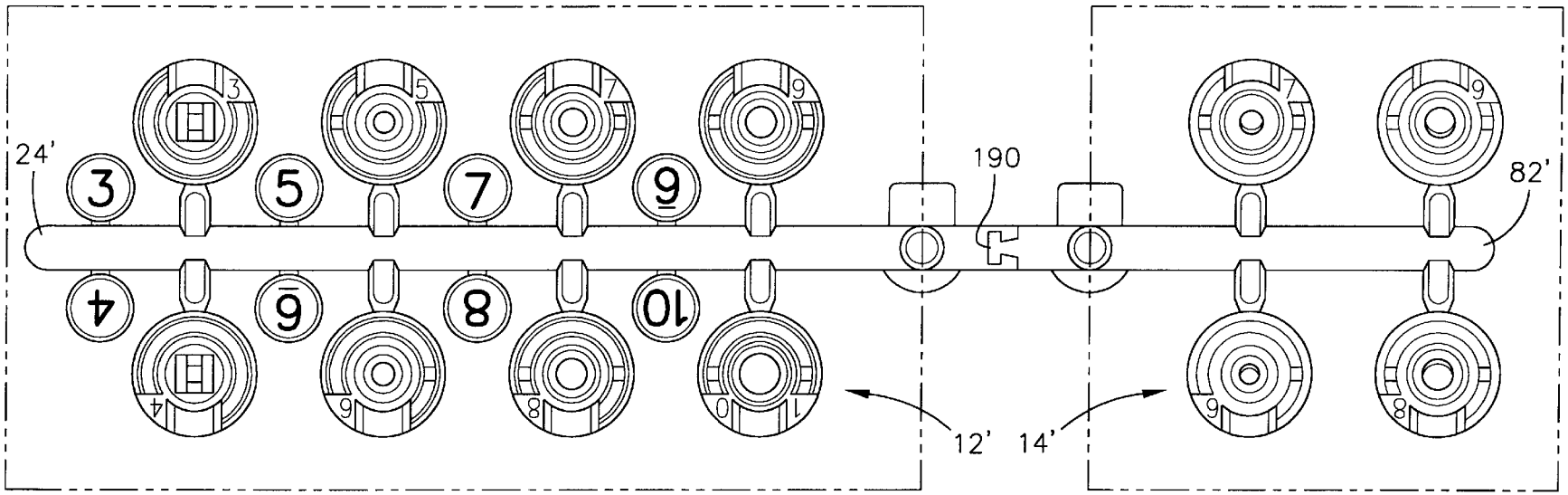
FIG. 5 is a view like FIG. 1 of a rack with a snap-fit connection.

It will be appreciated, as discussed above, that numerous different arrangements of the mold cavities may be made to mold multiple different nozzles of any number of different colors. These may be molded to emerge from the molds on a common carrier by any number of techniques as described wherein one or more extruder may be utilized with a dye being injected into the premolded plastic or into the runner system of the molds. Other means and methods of forming racks of different colored nozzles can also be utilized. For example, a number of sets of nozzles of selected colors may be connected together after they have been molded, such as by mechanical snap-fit or heat-weld as illustrated respectively in FIGS. 5 and 6. As illustrated in FIG. 5, branch 24', of the common runner that is also referred to as a linear support member, is connected to branch 82' of the runner with a T shaped snap-fit connection to connect set of nozzles 12' with set of nozzles 14'. To assemble the common runner, a T shaped plug 190 on branch 82' with set of nozzles 14'. To assemble the common runner, a T shaped plug 190 on branch 82' slips into a T shaped slot on branch 24' similar to a typical bayonet connection.

Figure 6:
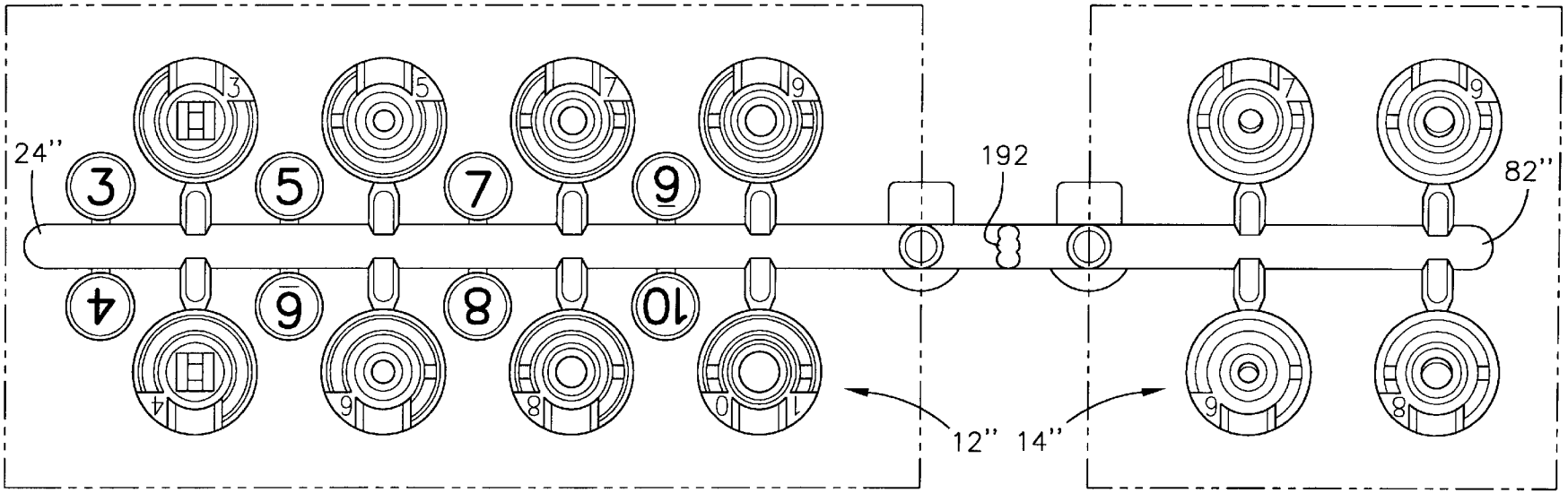
FIG. 6 is a view like FIG. 1 of a rack with a heat-weld connection.

In FIG. 6, a heat-weld 192 is illustrated wherein the branches 24" and 82" of the common runner for sets of nozzles 12" and 14" are positioned in abutting engagement and heated at the point of engagement until the plastic branches melt and weld together to form the common runner. In other words, single colored nozzles or sets of nozzles may be molded and later connected together in racks of multi-colored nozzles. Thus, the formation of the multi-colored racks is not limited by the molding process. It is also apparent that the nozzles can be individually mounted on a separately prepared rack or mount.

While I have illustrated and described my invention by means of specific embodiments, it should be understood that numerous changes and modifications may be made therein without departing from the spirit and scope of the invention as defined in the appended claims:

I claim:

1. An array of multiple injection molded plastic nozzles supported on a common structure, comprising:

a first nozzle molded of a plastic of a first color and adapted to be detachably mounted in a sprinkler unit;

a second nozzle molded of a plastic of a second color and adapted for detachably mounting in an outlet of a sprinkler unit; and said first and second nozzles interconnected by a runner formed during molding of said nozzles.

2. An array of nozzles according to claim 1 wherein said array includes a plurality of nozzles of each of said first and second colors.

3. An array of nozzles according to claim 1 wherein said array includes additional nozzles of additional colors.

4. An array of nozzles according to claim 3 wherein said array comprises at least five nozzles, each nozzle of a different color.

5. An array of nozzles according to claim 4 wherein said nozzles are in a circular array about a central axis.

6. An array of nozzles according to claim 5 wherein each nozzle is of a color that represents a predetermined rate of flow.

7. An array of nozzles according to claim 1 wherein said array of nozzles are disposed along a linear support member.

8. An array of nozzles according to claim 7 wherein said array includes additional nozzles of additional colors.

9. An array of nozzles according to claim 7 wherein said first and second nozzles are connected together by a snap connection between branches of the runner.

10. An array of nozzles according to claim 7 wherein said first and second nozzles are connected together by welding.

11. An array of nozzles according to claim 1 wherein said first and second nozzles are connected together by a snap connection between runners.

12. An array of nozzles according to claim 1 wherein said first and second nozzles are connected together by welding.

13. An array of multiple sprinkler nozzles of different colors mounted on a common support structure, comprising:

a support structure defined by at least one elongated runner formed during molding of a plurality of nozzles;

at least a first nozzle molded of a plastic of a first color mounted on said support structure and adapted to be detachably mounted in an outlet of a sprinkler unit;

at least a second nozzle molded of a plastic of a second color mounted on said support structure and adapted to be detachably mounted in an outlet of a sprinkler unit.

14. An array of nozzles according to claim 13 wherein said array includes a plurality of nozzles of each of said first and second colors.

15. An array of nozzles according to claim 14 wherein said array includes additional nozzles of additional colors.

16. An array of nozzles according to claim 14 wherein said array comprises at least five nozzles disposed in a circular array, each nozzle of a different color.

17. An array of nozzles according to claim 16 wherein each nozzle is of a color that represents a predetermined rate of flow.

18. An array of nozzles according to claim 13 wherein said first and second nozzles are connected together by a snap connection between runners.

19. An array of nozzles according to claim 18 wherein said array of nozzles are disposed along a linear support member.

20. An array of nozzles according to claim 13 wherein said first and second nozzles are connected together by welding.

21. An array of nozzles according to claim 20 wherein said array of nozzles are disposed along a linear support member.

* * * * *